US005104457A

United States Patent [19]

Viljoen et al.

[11] Patent Number: 5,104,457

[45] Date of Patent: Apr. 14, 1992

[54] GOLF CLUBS AND METHOD OF MAKING THEREOF

[75] Inventors: Kenneth V. Viljoen, Constantia Kloof; Alistair Elrick, Lea Glen, both of South Africa

[73] Assignee: Country Club Golf Equipment (Proprietary) Limited, South Africa

[21] Appl. No.: 373,457

[22] Filed: Jun. 30, 1989

Related U.S. Application Data

[63] Continuation-in-part of Ser. No. 159,111, Feb. 23, 1988, abandoned.

[51] Int. Cl.[5] ..... C22C 9/01; C21D 9/00

[52] U.S. Cl. ..... 148/3; 148/13.2; 148/436; 273/167 R; 420/489

[58] Field of Search ..... 148/3, 13.2, 11 SC, 148/436; 420/489; 273/167 R

[56] References Cited

FOREIGN PATENT DOCUMENTS 1187127 4/1970 United Kingdom ..... 148/13.2

*Primary Examiner*—Deborah Yee

*Attorney, Agent, or Firm*—Ladas & Parry

[57] ABSTRACT

The present invention provides for a method of making a golf club head which comprises the steps of casting the head in an alloy having copper and aluminum as its major constituents by weight, fettling the cast head as required, heat-treating the head by heating it to an temperature in the range 960° C. to 980° C. for a period of about two hours, water quenching the head, and finally of cleaning the cast, fettled and heat-treated head to give a desired finish thereto.

2 Claims, 1 Drawing Sheet

GOLF CLUBS AND METHOD OF MAKING THEREOF

This is a continuation-in-part of my previous U.S. patent application Ser. No. 159,111 filed Feb. 23, 1988, now abandoned.

BACKGROUND TO THE INVENTION

THIS invention relates to a method of making golf club heads.

Golf clubs are expensive commodities and thefts of clubs are on the increase. It would be desirable for an owner of golf clubs to have some means whereby he can personalise his clubs in an aesthetically pleasing way so that a would-be thief is dissuaded from stealing the clubs. In general terms, it is believed that the attraction of a set of clubs would be improved by the provision of personalising or other identifying indicia.

U.S. Pat. No. 2,846,228 to Reach describes a golf club having a head formed with a recess at its rear. The recess is filled with a rubber material to add to the weight of the head, the rubber material carrying an identifying marking. U.S. Pat. No. 3,814,437 to Winquist describes a golf club which also has a recess at the rear of the head and which has an emblem or symbol which may be a separate item fixed in the recess. The emblem is also intended to provide a reinforcing function for the head.

One disadvantage with both of these arrangements is that the identifying emblem is exposed at the rear of the club. In the nature of things, clubs are often roughly treated and tend to bump against one another in the golf bag during play, with the result that the emblem could easily be damaged or become detached from the club head.

Stainless steel is the material preferred for the manufacture of "iron" clubs such as those described in the above U.S. patents. However, it is appreciated that steel is not an optimum material insofar as the "feel" of the club when striking a golf ball is concerned and also insofar as manufacturing expense is concerned.

One object of the invention is to provide a method of making a golf club head whose head is fitted with a well protected indentifying emblem. Another object is to provide a method of making such a golf club head of a material other than stainless steel.

SUMMARY OF THE INVENTION

The invention provides: a method of making a golf club head which comprises the steps of casting the head in an alloy having copper and aluminum as its major constituents by weight, fettling the cast head as required, heat-treating the head by heating it to an temperature in the range 960° C. to 980° C. for a period of about two hours, water quenching the head, reheating it to a temperature of about 450° C. and cooling the head, and finally of cleaning the cast, fettled and heat-treated head to give a desired finish thereto.

The club head may be cast in an alloy having copper and aluminum as its major constituents by weight. A preferred method provides for making a golf club head wherein the head is cast in an alloy having the following composition by weight:

Al: 4.5 to 12%
Fe: 0 to 5%
Ni: 0 to 5%
Mn: 0 to 12%

Sn: 0 to 1%
Pb: 0 to 1%
Zn: 0 to 1%
Si: 0 to 1%
Cu: The balance

A most preferred composition resulting from the inventive method is, by weight:

Sn: 0.02%
Pb: 0.07%
Zn: 0.12%
Ni: 4.43%
Fe: 4.69%
Al: 9.17%
Si: 0.05%
Mn: 0.33%
Cu: The balance

DESCRIPTION OF PREFERRED EMBODIMENTS

Figure 1:
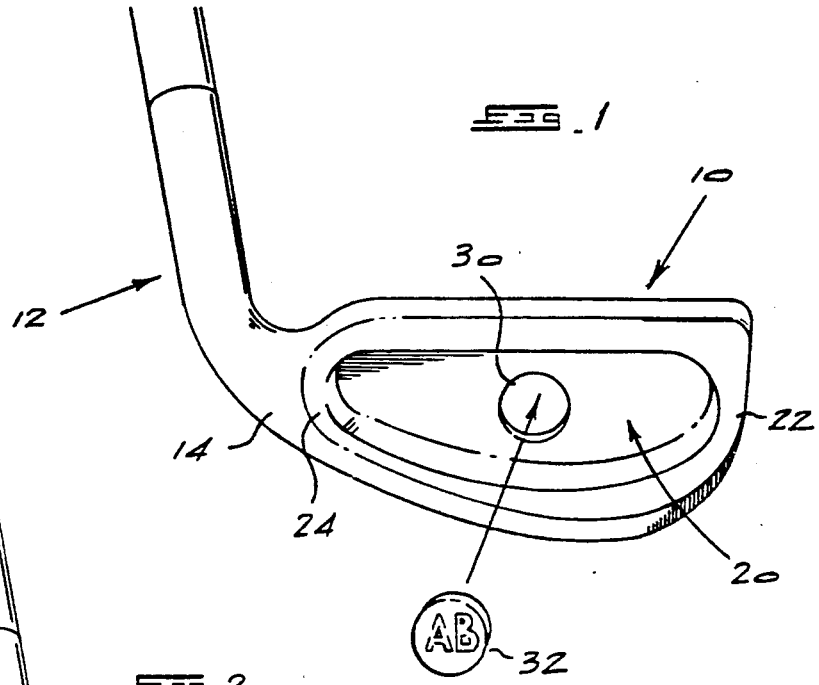
FIG. 1 shows a rear perspective view of a golf club head according to the invention, the emblem being exploded away.
Figure 2:
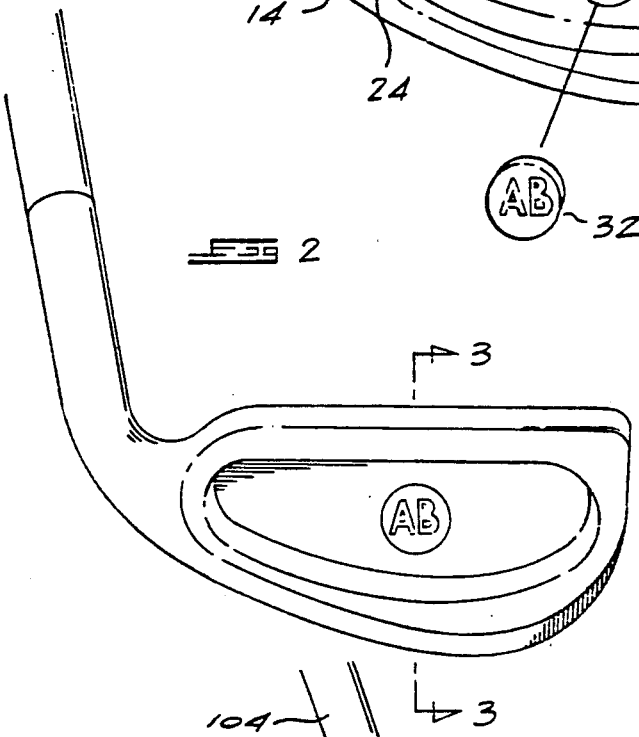
FIG. 2 shows the same golf club head with the emblem secured in position.
Figure 3:
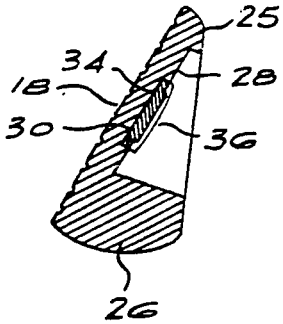
FIG. 3 shows a section at the lines 3—3 in FIG. 2.

The cast golf club head according to the method is illustrated in FIGS. 1 to 3 and is that of a six-iron of the perimeter weighted type. It has a blade 10 and a hosel 12 which is connected to the blade at a neck 14. The lower end of a flexible shaft 16 is inserted into the hosel and is secured there by conventional means.

The front of the blade 10 provides a striking surface 18 which has the usual series of parallel grooves.

The rear of the blade has a central, generally oval recess 20 with the result that the weight of the head is concentrated towards the toe 22, the heel 24, the top 25 and the sole 26 i.e. towards the perimeter of the blade. As is evident from FIG. 3, the base 28 of the recess 20 is planar. The base is formed with a shallow, circular depression 30 mid-way between the heel and the toe.

FIG. 1 illustrates a circular emblem 32 one major surface 34 of which is generally planar. The opposite major surface 34 of the emblem has raised letters, in this case, the letters "AB" on a dark background. The letters are glazed over with a clear resin 36. The diameter of the emblem is chosen for it to be a snug fit in the depression 30 inside the cavity 20.

The emblem is stuck into the depression 30 using an epoxy resin or other suitably strong adhesive, the result being that the letters "AB" are clearly visible to an observer.

The idea is that when a golfer purchases a set of clubs, each of the clubs in the set will have an emblem 32 which bears his personal initials or other indicia identifying the clubs. Other possibilities are for indicia to identify a particular golf club at which the golfer plays, or the pro shop from which the clubs were purchased.

The nature of the adhesion of the emblem to the club head may be such as to permit its detachment and replacement. This may be necessary if, for instance, the golfer should sell that particular set of clubs and the new owner wish to have different personalizing or other identifying indicia on the clubs. In a case where the emblem has been stuck in place using an epoxy resin, a suitable heat treatment can be used to detach the obsolete emblems from the set so that new emblems can be attached in their places.

It is anticipated that the provision of the clearly visible identifying emblem on a golf club will dissuade a would-be thief from stealing that golf club. In addition, the personalisation or other identification which can be achieved with the emblem will, it is believed, be attractive to golfers. Furthermore, the indicia could be the logo of a company or the like which wishes to distribute sets of clubs to its respected customers as a goodwill gesture and for promotional purposes.

Figure 4:
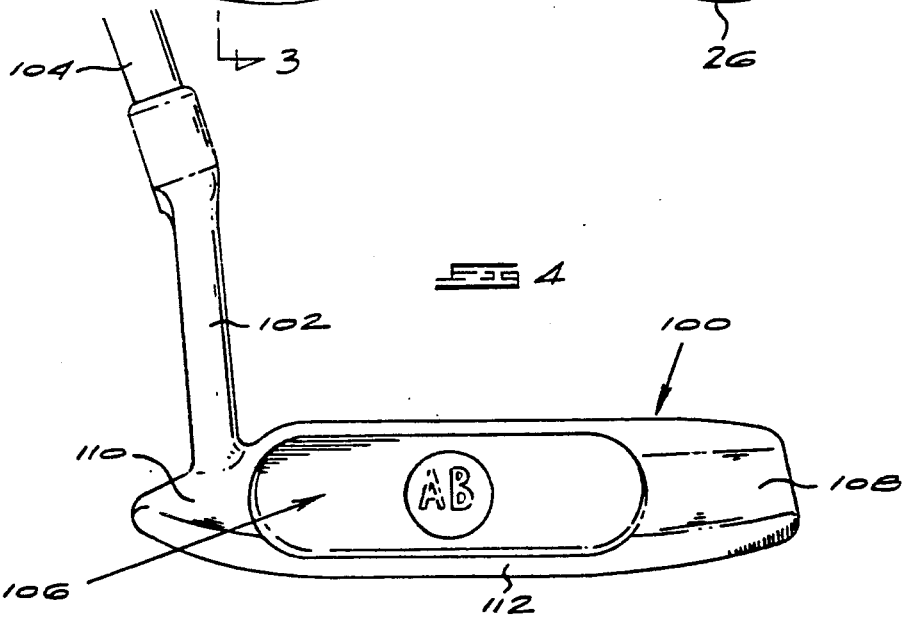
FIG. 4 shows a rear perspective view of another golf club head, in this case a putter head.

The invention is not applicable only to the irons of a set of golf clubs, but also to golf putters. FIG. 4 shows a rear perspective view of a toe-and-heel putter head having a blade 100 with a hosel 102 connected to the lower end of a shaft 104. As in the case of the six-iron described previously, the putter head includes a recess 106 at its rear, with concentrations of weight towards the toe 108, the heel 110 and the sole 112, such weight concentrations bordering the recess 106 at its ends and bottom. The top of the recess is bordered by a lip 114.

Once again, there is a shallow circular depression in the base of the recess 106, with an indicia-bearing emblem stuck into the recess.

One major advantage of the illustrated golf club heads when compared to known heads, such as those described in U.S. Pat. Nos. 2,846,228 and 3,814,437, is the fact that the emblem is securely protected against dislodgment in the event of an impact on the head when it is roughly treated or when it bumps against other clubs in a golf bag. The secure protection of the emblem arises by virtue of the fact that it is located in a protective depression which is itself located in a recess at the rear of the club head. This means that it will be extremely difficult for blunt objects, such as other golf club heads, to make direct contact with the emblem and damage or dislodge it from the head.

Another major advantage of the illustrated club heads arises by virtue of their composition which is, in this case, an alloy having copper and aluminium as major constitutents by weight.

The club head may be of an aluminium bronze alloy having the following approximate composition by weight:

Sn: 0,02%
Pb: 0,07%
Zn: 0,12%
Ni: 4,43%
Fe: 4,69%
Al: 9,17%
Si: 0,05%
Mn: 0,33%
Cu: The balance The golf club head has a golden colour which will, it is believed, be most attractive to golfers. Depending on the final finishing operations, the head may have either a shiny or a matte finish.

One of the major advantages of the aluminium bronze alloy is that the melting temperature is considerably lower than that used in melting operations to produce case stainless steel heads. The alloy has a melting temperature of about 1200° C. and this enables melting to be carried out in a gas or coke fired furnace which involves considerably less capital expense than an induction furnace such as is required to smelt steel. Of course, an induction furnace can also be used.

It is anticipated that fettling costs i.e. the costs of trimming or otherwise surface-finishing the aluminum bronze prior to heat treatment will be less than the equivalent fettling costs with stainless steel.

After casting, the heads are heated to around 1000° C. preferably between 960° C. and 980° C. for about two hours and are then waterquenched. Finally, the head is heated again to about 450° C. before being permitted to cool slowly in air. The product resulting from this heat treatment treatment procedure has admirable qualities as far as tensile strength, hardness, elongation and yield strength are concerned. This is indicated by the following table which demonstrates comparative values for the head of the invention and a conventional stainless steel head.

TABLE

| | INVENTION (Aluminium Bronze) | CONVENTIONAL (Stainless Steel) |
|---|---|---|
| Yield Stress | 469 MPa | 205 MPa |
| Tensile Stress | 827 MPa | 515 MPa |
| Elongation | 12% | 40% |
| Hardness | 230 HB | 88 (annealed) HB |

After the heat treatment step, the golf club head can be cleaned in any one of a number of different known ways, including treatment with a strong alkaline solution, tarnish removal, bright dipping, polishing and buffing, and organic coating. A nitriding process can also be used to create a lustrous black appearance in treated areas.

Besides the fact that the aluminium bronze as described above can be smelted at lower temperatures than stainless steel, the resulting club head has the major advantage that it has a better "feel" for the golfer when he strikes a golf ball. By this is meant that the golfer enjoys a smoother feeling during impact with the ball without a jarring sensation as is sometimes experienced with stainless steel clubs. This applies to putter heads such as that illustrated in FIG. 4 as well as "iron" clubs such as that illustrated in FIG. 1.

Also, the gold colour of the head combines with the emblem to provide a most pleasing appearance.

We claim:

1. A method of making a golf club head which has:

a) a blade having a toe, a heel, a top edge, a sole, a front, generally planar ball-striking surface extending from the toe to the heel, a rear surface extending from the toe to the heel, a recess so positioned in the rear surface that the weight of the blade is concentrated about the perimeter of the recess at the toe, the heel, the sole and the top edge thereof; and b) a hosel for receiving the end of a golf club shaft connected to the heel of the blade at a neck;

c) the following composition by weight:

Al: 4.5 to 12%
Fe: 0 to 5%
Ni: 0 to 5%
Mn: 0 to 12%
Sn: about 0.02%
Pb: about 0.07%
Zn: about 0.12%
Si: about 0.05%
Cu: The balance, wherein the method comprises the steps of casting the head in one piece, fettling the cast head as required, heat-treating the head by heating it to a temperature in the range 960° C. to 980° C. for a period of about two hours, water quenching the head, reheating the head to a temperature of about 450° C. and then cooling it, and finally cleaning the cast, fettled and heat-treated head to a desired finish thereto.

2. A golf club head comprising:

a) a blade having a toe, a heel, a top edge, a sole, a front, generally planar ball-striking surface extending from the toe to the heel, a rear surface extending from the toe to the heel, a recess so positioned in the rear surface that the weight of the blade is concentrated about the perimeter of the recess at the toe, the heel, the sole and the top edge thereof; and b) a hosel for receiving the end of a golf club shaft connected to the heel of the blade at a neck;

wherein the blade, hosel and neck are cast as a one-piece casting in an alloy having the following composition by weight:

Al: 4.5 to 12%
Fe: 0 to 5%
Ni: 0 to 5%
Mn: 0 to 12%
Sn: about 0.02%
Pb: about 0.07%
Zn: about 0.12%
Si: about 0.05%
Cu: The balance.

* * * * *